US005259596A

United States Patent [19]

Ruffaldi

[11] Patent Number: 5,259,596

[45] Date of Patent: Nov. 9, 1993

[54] EROSION RESISTANT STOPPER ROD

[75] Inventor: Aldo Ruffaldi, Kraainem, Belgium

[73] Assignee: Vesuvius Crucible Company, Pittsburgh, Pa.

[21] Appl. No.: 864,855

[22] Filed: Apr. 7, 1992

[30] Foreign Application Priority Data

Apr. 9, 1991 [FR] France ..... 91 04403

[51] Int. Cl.[5] ..... B22D 41/18

[52] U.S. Cl. ..... 266/271; 222/597; 222/602

[58] Field of Search ..... 222/591, 597, 602, 606, 222/607; 266/271

[56] References Cited

U.S. PATENT DOCUMENTS

| | | | |
|---|---|---|---|
| 1,439,522 | 12/1922 | Howard | 222/602 |
| 1,486,694 | 3/1924 | Sheaffer | 266/271 |
| 1,776,773 | 9/1930 | Arensberg | 222/602 |
| 3,011,231 | 12/1957 | Drever | 222/602 |
| 3,456,690 | 7/1969 | Weed | 266/271 |
| 4,779,775 | 10/1988 | Kimura et al. | 222/606 |
| 5,083,687 | 1/1992 | Saito et al. | 222/606 |

FOREIGN PATENT DOCUMENTS

| | | |
|---|---|---|
| 2464769 | 3/1981 | France . |
| 8404477 | 11/1984 | PCT Int'l Appl. . |
| 2123726 | 2/1984 | United Kingdom . |

OTHER PUBLICATIONS

Patent Abstracts of Japan, vol. 12, No. 343 (JP-A-63 104 760 to Sumitomo Metal Ind Ltd) Sep. 14, 1988.

*Primary Examiner*—Scott Kastler

*Attorney, Agent, or Firm*—Webb Burden Ziesenheim & Webb

[57] ABSTRACT

Erosion resistant stopper rod for steel casting having an elongated body of a first refractory material and a sleeve of a second refractory material having elevated erosion resistance characteristics. The sleeve may be copressed with the stopper rod body or separately formed and cemented thereto. The sleeve is positioned around the stopper rod in the region where contact with the slagline occurs. The erosion resistant material of the sleeve is selected from the group consisting of zirconia, magnesia, zirconia-graphite and magnesia-graphite.

6 Claims, 1 Drawing Sheet

EROSION RESISTANT STOPPER ROD

BACKGROUND OF THE INVENTION

Currently, the continuous casting process is widely used in the metallurgy of iron and steel. As molten metal emerges from a converter furnace or vessel, it is poured into a ladle of high capacity, then poured into a distributor or tundish of lesser capacity which permits continuous delivery of the metal into one or more bottomless molds for solidification therein.

The flow of molten steel from the tundish to the mold or molds is regulated and/or stopped by various means. At the present time, the most widely used apparatus in Europe for controlling metal flow is the stopper rod. A stopper rod is an elongated piece of refractory material that extends downwardly into the molten steel. The lower end of the stopper rod bears against the seat of a casting orifice provided in the bottom of the tundish. An arm fixed to the upper portion of the stopper rod makes it possible to selectively move the lower end of the stopper rod a regulated distance from the seat of the pouring orifice and, thus, meter or completely stop the flow of molten metal to the molds. Rotary valve devices are also known, in which the flow of metal from the tundish is regulated by selective rotation of the device.

The upper surface of the molten metal contained both in the ladle and in the tundish is usually covered with a protective covering powder, generally of a synthetic nature. This covering powder has several functions. The powder prevents oxidation of the molten metal by isolating it from the ambient air, it reduces the heat losses from the melt and it also traps inclusions that rise to the surface of the molten steel.

Nevertheless, the use of a covering powder is not without its disadvantages. Indeed, this floating powder layer causes erosion of the stopper rod at the level of its line of immersion in the steel sometimes referred to as the "slagline". This erosion is of serious concern at present since the powders currently used are quite chemically aggressive relative to the refractory materials used to produce the stopper rods. A layer of slag floats on the surface of the molten metal contained in the ladle. This slag originates from the impurities contained in the iron ore and which, being lighter than the steel, rise to its surface when it is melted. To the greatest extent possible, an attempt is made to prevent the slag contained in the ladle from passing into the tundish by closing the ladle before the slag begins to pass into the tundish. Despite this precaution, it is inevitable that a certain amount of slag passes into the tundish. This slag also has a corrosive action on the refractory stopper rod in addition to covering powder.

The combined erosion of the slag and the covering powder causes a reduction in cross-section and subsequent weakening of the stopper rod at its immersion line in the molten metal. This gradual reduction in cross-section structurally weakens the stopper rod and will eventually cause its rupture. Such a rupture leads to a loss of control of the metal flow from the distributor vessel. All the metal contained in the tundish is then lost and can cause considerable damage to the continuous casting mold, as well as the entire casting installation, resulting in considerable expense due to lost production, and clean-up costs. Such inadvertent stopper rod failure also involves considerable physical risk to the personnel in the vicinity of the tundish resulting from the uncontrolled flow of molten steel. It is, thus, absolutely necessary to avoid any possibility of stopper rod rupture.

Because of these safety concerns and attendant operational problems, it is common to interrupt the casting sequence as soon as erosion of the stopper rod presents a risk of rupture. Erosion of the stopper rod is thus a factor that limits the duration of the casting sequence; that is, the number of ladles that can be cast in the same sequence. It is readily understood that the cost per ton of steel can be reduced if the casting sequence is extended. Thus, the stopper rod life has a direct effect on steel production costs.

SUMMARY OF THE INVENTION

The present invention provides a stopper rod that remedies the above shortcomings. The stopper rod of the invention has an increased resistance with respect to erosion by the slag as well as erosion by the covering powder. As a consequence, the stopper rod of the invention provides longer casting sequences while minimizing the risk of rupture. The present invention also may be applied to known rotary valve devices.

The stopper rod of the present invention has a sleeve formed from an erosion resistant material. The erosion resistant sleeve is located at a height such that, when the stopper rod is in use, the erosion resistant sleeve is at the level coincident with the immersion line or slagline of the stopper rod. Since the chemical erosion occurs at the level of the erosion resistant sleeve, this section of the stopper rod is not eroded at the high rate heretofore experienced in the prior art. The sleeve has a vertical height sufficient to accommodate normal variations in the level of the molten steel in the vessel, as well as vertical movements of the stopper rod during metering and closing operations.

The present invention, thus, prevents mechanical weakening of the stopper rod and provides increased safety, as well as a greatly extended service life. Consequently, the duration of the casting sequence is lengthened substantially, resulting in obvious economic advantages.

According to a first presently preferred embodiment, the stopper rod of the invention has an elongated body of a first refractory material, while the erosion resistant sleeve is of a second refractory material having excellent erosion resistance characteristics. The stopper rod is thus composed of at least two materials, i.e., the material forming the body, which does not have particularly high erosion resistance characteristics, and the erosion resistant material of the sleeve, located at the level of the immersion line of the stopper rod in the steel. For example, the material possessing high erosion resistance is chosen from the group consisting of zirconia, magnesia, zirconia-graphite and magnesia-graphite.

According to another presently preferred embodiment, the stopper rod of the invention consists of an elongated body having an erosion sleeve defined by an area of increased diameter at the slagline. This region of increased diameter may be made from the same refractory material as that of the body. In this embodiment, the entire stopper rod and collar are thus formed of a common refractory material. Alternatively, the region of increased diameter at the slagline may be made, at least in part, from a second refractory material different from that of the body. The second material preferably has excellent chemical erosion resistance characteristics with regard to the slag and covering powder.

The erosion resistant sleeve may be formed as a separate, unitary piece and affixed or cemented around the outer surface of the body. The sleeve can also be made of two or more parts as a split ring, for example, which then permits its placement into an appropriate ring-shaped recess formed in the body. If the depth of the recess corresponds to the thickness of the sleeve, the sleeve will form a uniform cross-section with the body.

The invention also employs a process of stopper rod manufacture wherein the sleeve is first formed separately from the body, for example, by hydraulic pressing, and then, while still in the green state, the preformed sleeve is isostatically pressed with the body. According to one variation of this method, the refractory powder or grain of the material mix forming the sleeve, may be introduced into the mold at the same time as the refractory material mix comprising the body of the stopper rod. The materials are co-pressed isostatically in a single operation and the resulting pressed shape is then fired in a known manner.

BRIEF DESCRIPTION OF THE DRAWINGS

Other characteristics and advantages of the present invention will become apparent in reading the following specification taken with the appended drawings, in which:

FIG. 1 depicts a first preferred embodiment of the invention showing the overall stopper rod. The stopper rod has a body 1, generally of elongated shape, having an upper part 1*a* and a lower part 1*b*. Attachment means are provided in the upper part 1*a* of the stopper rod, for example, a threaded metal insert, such as insert 2, or any other means of fixation that permits the stopper rod to be attached to a conventional lifting lever (not shown). The lower part 1*b* of the stopper rod terminates in a nose of rounded or conical form, designed to closely fit on a seat provided in the bottom of a metallurgical vessel such as a ladle, tundish or like molten metal distributor (not shown). In FIG. 1, the nose of the stopper rod is preferably made from a refractory material different from that of the body 1 to provide the nose portion with increased erosion resistance since erosion due to flowing steel is particularly high in the nose zone. While desirable, this characteristic is not indispensable and the nose could, of course, be made from the same material as the body, if desired. The stopper rod body 1 may also have an axially extending, longitudinal through channel 3, which terminates at the lower end of the nose for the injection of an inert gas such as argon into the melt. The presence of the channel 3, while not obligatory, is beneficial in providing additional inert gas flow into the melt. It will be appreciated, however, that the presence of the axial channel 3 contributes to the weakening problems associated with conventional stopper rods due to the reduced cross-section caused by the presence of the channel.

According to the invention depicted in FIG. 1, the stopper rod has a sleeve 4 formed from a refractory material that has an excellent resistance to chemical erosion. In FIG. 1, the sleeve 4 is comprised of a material different from that of the body 1. For example, the body 1 can be of a conventional alumina-graphite refractory mix, while the sleeve 4 may be of magnesia, zirconia, zirconia-graphite, magnesia-graphite or other corrosion resistant refractory material. It should be noted that the sleeve 4 depicted in FIG. 1 has the same outer diameter as that of the body 1. The sleeve 4 can be produced by different processes. First, the sleeve 4 may be co-pressed isostatically at the same time as the body 1 of the stopper rod, with two variants possible. According to a first variant, the sleeve is produced separately, such as by hydraulic pressing. The as-pressed or "green" sleeve is then placed in the body mold. The mold is next filled with the refractory material mixture forming the body. The composite unit comprising the pre-pressed sleeve 4 and the refractory mixture of the body is then co-pressed isostatically. The pressed composite is then fired in known fashion.

According to a second method of manufacture, the mold is filled with the refractory material mixture forming the body 1 and the refractory material mixture forming the sleeve. The mixture is then co-pressed isostatically in a single operation and the co-pressed shape subsequently fired.

The sleeve may also be produced separately in two or more segmented, ring-shaped parts and inserted in a recess provided in the body and then attached, for example, by cementing into the recess.

Figure 2:
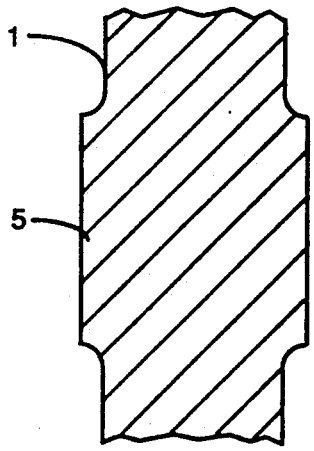
FIG. 2 is a fragmentary, cross-sectional side view of a second preferred embodiment of a stopper rod produced in accordance with the invention.

FIG. 2 shows a further presently preferred embodiment of the invention, in which the erosion-resistant sleeve designated 5 is created by a region of increased thickness made from the same refractory material as the body 1. This variant is particularly simple and economical to produce since only one refractory material is employed. The embodiment of FIG. 2 offers an increased resistance to erosion because the slagline section of the stopper rod is augmented at the level of the immersion line in the molten metal. It thus makes it possible to lengthen the duration of the casting run in a simple and economical manner.

Figure 3:
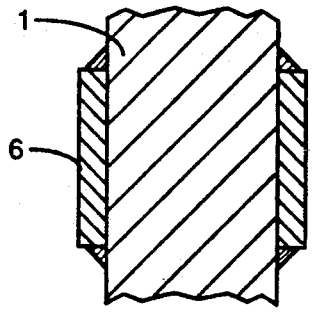
FIG. 3 is a fragmentary view similar to FIG. 2 of another embodiment of the invention.

FIG. 3 depicts a third variant of the present invention. A ring-shaped sleeve 6 has an inner diameter equal to the outer diameter of the body 1 and, thus, forms a region of excess thickness relative to the body of the stopper rod. Sleeve 6 may be produced as a unitary, ring-shaped part which is slipped onto the body 1 and cemented in an appropriate position on the body. The ring-shaped sleeve 6 may also be made of two or more segmented parts, although this mode of construction is not particularly attractive because the body shown in FIG. 3 does not have a recess may be necessary to provide adequate foundation strength to a two piece sleeve.

Figure 1:
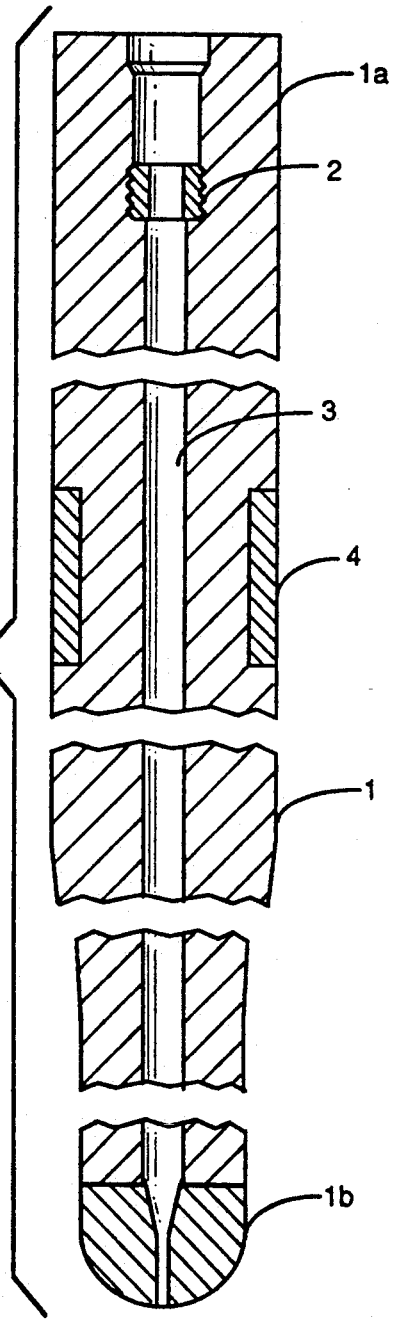
FIG. 1 is a fragmentary, cross-sectional side elevation view of a stopper rod according to the invention.
Figure 4:
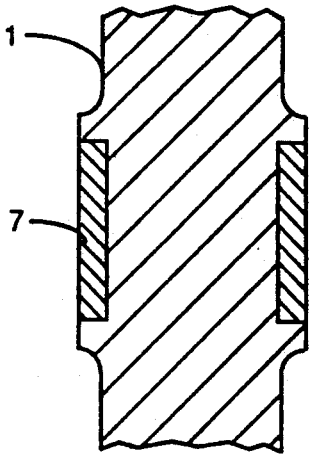
FIG. 4 is a fragmentary view similar to FIGS. 2 and 3 of yet another embodiment of the invention.

FIG. 4 shows a further presently preferred embodiment of the improved erosion resistant stopper rod of the invention. This variant combines the characteristics of the embodiments of FIGS. 1 and 2. The erosion resistant slagline region is formed by a ring-shaped element 7 made from a refractory material having particularly high erosion resistant characteristics. In this variant, however, the ring-shaped sleeve 7 has an inner diameter substantially of the same dimension as the outer diameter of the body 1. Thus, sleeve 7 forms a region of greater thickness that augments the cross-section of the stopper rod 1 at the slagline level when immersed in the molten metal. An increase in erosion resistance is thus obtained in the embodiment of FIG. 4 both by the characteristics of the erosion resistant refractory material of the sleeve 7 and also by an increased diameter of the sleeve. This variant, as that of FIG. 3, provides particularly long casting sequences.

While specific embodiments of the invention have been described in detail, it will be appreciated by those skilled in the art that various modifications and alternatives to those details could be developed in light of the overall teachings of the disclosure. The presently preferred embodiments described herein are meant to be illustrative only and not limiting as to the scope of the invention which is to be given the full breadth of the appended claims and any and all equivalents thereof.

I claim:

1. A stopper rod for regulating the flow of molten metal from a tundish containing a volume of molten metal therein and having a layer of slag-like material, defining a slagline floating on an upper layer of said molten metal, said stopper rod comprising an elongated, monolithic body of alumina-graphite refractory material and having a nose portion formed at a lower end adapted to be vertically moved to selectively engage and disengage a casting orifice in said tundish, an erosion resistant sleeve integral with and surrounding said body extending vertically along a region where contact with the slagline in said tundish occurs in both an engaged and disengaged position whereby constant shielding of the stopper rod body from slag attack is provided by said sleeve, said sleeve being formed of one or more refractory materials selected from the group consisting of zirconia, magnesia, zirconia-graphite and magnesia-graphite.

2. Stopper rod according to claim 1, wherein the erosion resistant sleeve comprises a region of the body having an increased diameter.

3. Stopper rod according to claim 2, wherein the region of increased diameter comprises a sleeve fixed on an outer surface of the body.

4. Stopper rod according to claim 3, wherein the sleeve is produced in at least two parts and fixed in a recess formed in the body.

5. Stopper rod of claim 3, wherein the sleeve has an inner diameter substantially the same as an outer diameter of the body.

6. The stopper rod of claim 1 wherein the erosion resistant sleeve is isostatically co-pressed with said body.

* * * * *

UNITED STATES PATENT AND TRADEMARK OFFICE

CERTIFICATE OF CORRECTION

PATENT NO. : 5,259,596

DATED : November 9, 1993

INVENTOR(S) : Aldo Ruffaldi

It is certified that error appears in the above-indentified patent and that said Letters Patent is hereby corrected as shown below:

Column 2, Line 62, "collar" should read --sleeve--.

Signed and Sealed this

Nineteenth Day of April, 1994

Bruce Lehman

*Attest:*

BRUCE LEHMAN

*Attesting Officer*

*Commissioner of Patents and Trademarks*